United States Patent [19]

Danley, Sr.

[11] 4,304,005

[45] Dec. 8, 1981

[54] DEVICE FOR ATTACHING AN EYE SHIELD TO A CAP

[76] Inventor: Clifford L. Danley, Sr., 241 SW. 53rd Ave., Plantation, Fla. 33317

[21] Appl. No.: 163,182

[22] Filed: Jun. 26, 1980

[51] Int. Cl.[3] ..... A42B 1/06

[52] U.S. Cl. ..... 2/10; 2/199

[58] Field of Search ..... 2/10, 12, 199, DIG. 6

[56] References Cited

U.S. PATENT DOCUMENTS 2,538,608 1/1951 Vaca ..... 2/10

2,619,641 12/1952 Vaca ..... 2/10

FOREIGN PATENT DOCUMENTS 345833 4/1931 United Kingdom ..... 2/10

*Primary Examiner*—Peter P. Nerbun

*Attorney, Agent, or Firm*—Malin & Haley

[57] ABSTRACT

A device for attaching a variety of various eye shields or spectacles, safety shields or the like to a cap which allows for variable adjustment in the location of the spectacles with respect to the cap, removeable attachment, and two position up-down positioning of the eye shield comprising one or more wire frames which are attached by upper and lower velcro strips to a cap visor, the frame having a pair of clips which attach the eye shield or spectacle to the frame. Each frame is formed from a light weight unitary wire that allows for frictionally holding the eye shield in an up or down position relative to the wearer and wearer's vision. The base of the frame is removeably attached to the cap by a fabric fastener such as velcro which is attached in layers to the lower side of the visor and by an additional strip that goes over the base of the frame. A variety of eye shields, lenses, sunglasses, or the like can be readily detached or interchanged with each frame or frames.

3 Claims, 3 Drawing Figures

DEVICE FOR ATTACHING AN EYE SHIELD TO A CAP

BACKGROUND OF THE INVENTION

This invention relates generally to a device for attaching an eye shield, glasses, sunglasses, corrective lenses, or other type of optical device to a hat or cap, and specifically to an improved supporting device which can be readily adjusted to fit a particular individual on any type of cap having a prominance or visor protruding therefrom.

Cap combinations using eye shields or employing optical devices are known in the prior art. The devices shown to date however have several drawbacks. In the permanently attached models (where the eye shield is fixed to the cap) should the cap become worn out or stained or permanently damaged or should the eye shield itself become damaged, the entire device must be thrown away. In the "clip-on" type of eye shields which clip around the brim of the visor, the devices have been structured to accomodate one particular type of eye shield or optical device and can only be attached at one location (along the visor edge).

The present invention overcomes the disadvantages of the devices previously shown by providing an easily attachable or detachable optical supporting device for mounting on a cap brim, visor or the like that can be adjusted relative to the cap surface to accommodate the wearer, and can be used for interchanging various types of eye shields, spectacles, safety shields or the like.

SUMMARY OF THE INVENTION

A device for removeably attaching an eye shield, optical lens or other optical device to a hat or cap visor or brim comprising one or more lightweight frame members each of said frame members having a base portion, a first fabric fastening strip mounted on said hat visor surface, a second fabric fastening strip attachable to the first strip for receiving the base frame portion to allow firm attachment of the frame member between the first and second fabric fasteners, and a pair of spring clips for receiving the optical or eye shield member for attaching the eye shield to the frame.

Each frame member includes in one embodiment a single unitary piece of spring steel which is bent and shaped to provide for first and second positioning of the optical device attached thereto (up or down position) and a base portion that is attached between the fabric fasteners.

Each frame member also includes first and second spring clips attached at the ends of a U-shaped segment of the wire and a spring fastener that is contoured to hold the U-shaped fastener and to pivotally allow the spring shaped fastener to go from an open to a closed position.

The eye shield itself may be a single elongated piece made from plastic, glass, or may accommodate individual glasses one on each side with a frame member on each side.

One tremendous advantage of the present invention is that using fabric fasteners along the underside of the cap visor or brim the device may be positioned relative to the wearer's eyes at any desired location quickly and firmly. Furthermore with the fabric fasteners the device is readily detachable from the cap and can be used interchangeably with different lenses, eye shields, safety glasses or the like. This is regardless of the width or length of the lens or the nature of the lens.

The frame is such that the lens can be positioned in an up or down mode with a friction or spring loading for positive locking in the up or down position.

Another advantage of the invention is that it can be literally used with any type of head gear hat regardless of whether it's any type of sporting cap having a visor or brim or a straw hat or hat of literally any material.

The frame itself includes a base portion which is substantially a flat piece of wire with a pair of ends connected perpendicular thereto each of which is bent back in a symmetrical fashion to form almost a complete loop, an elongated portion from there which again is bent back in a U-shaped fashion forming a secondary loop. The mounting portion which allows the spectacle to be mounted to the frame is then disposed between the pairs of almost closed loops in a tension manner which allows for secure fit between the spectacles and the frame members.

It is therefore an object of this invention to provide a device for attaching an eyeshield which can be readily installed on any type of hat with a prominance.

It is another object of this invention to provide a device for attaching an eyeshield which can be adjusted relative to the surface of the cap prominance, brim, or visor to accommodate the wearer.

It is yet another object of this invention to provide a device for attaching an eyeshield which allows for the use of interchangeable eyeshields.

It is yet still another object of this invention to provide a device for attaching an eyeshield which allows for the positioning of the eyeshield either in the line of vision of the wearer or out of the line of vision of the wearer.

In accordance with these and other objects which will be apparent hereinafter, the instant invention will now be described with particular reference to the accompanying drawings.

DESCRIPTION OF THE PREFERRED EMBODIMENT

Figure 1:
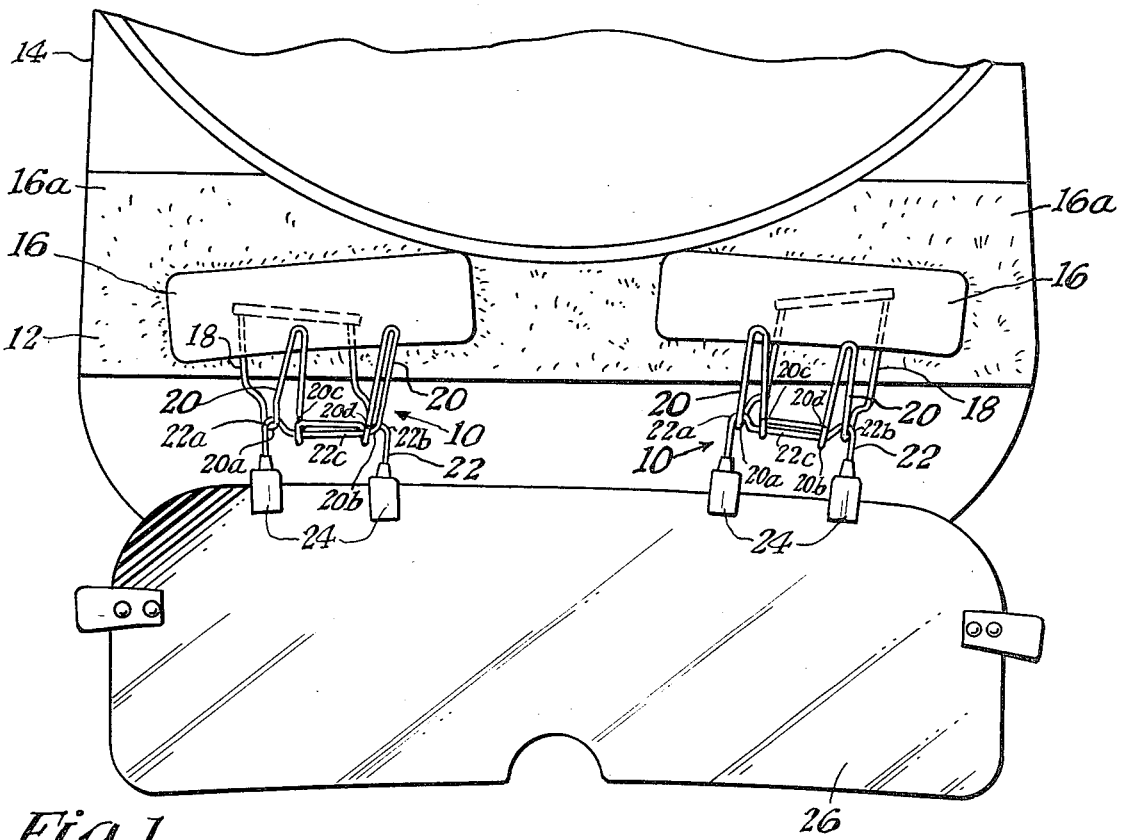
FIG. 1 is a fragmentary bottom elevational view of the device attached to the visor of a cap.
Figure 3:
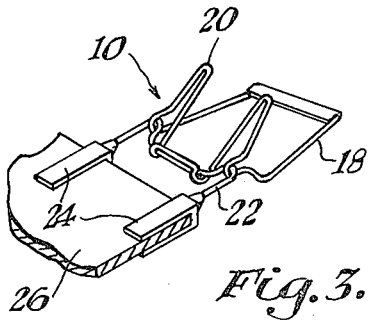
FIG. 3 is a perspective view of the device in the up position.

Referring now to FIGS. 1 and 3, the wire frames 10 are shown connected to the visor 12 of the cap 14 by way of the velcro strips 16. Each of the frames 10 includes a base portion 18 having one end formed to allow firm attachment of the base portion between fabric fasteners 16 and 16*a*. The fabric fasteners are preferrably made of Velcro. The opposite end of the base portion includes a pair of spring clips 20 which engage the U-shaped eye shield member 22 in an open or closed position. Each of the eye shield members 22 include a pair of retaining brackets or U-shaped clamp member 24 which slidably engage the eye shield 26.

The rear corners 22*a* and 22*b* of the U-shaped eyeshield member 22 are looped or curved in order to engage with a first pair of loops or curvatures 20*a* and 20*b* of the spring clip 20. The substantially straight portion 22*c* of the U-shaped eyeshield member 22 which is intermediate the rear corners 22*a* and 22*b* engages with a second pair of loops 20*c* and 20*d* which enables the frame member 10 to be locked in the up position by the spring tension and friction between the spring clips 20 and the intermediate straight portion 22*c*. When the frame member 10 is in the down position the intermediate straight portion 22*c* disengages with the second pair of loop members 20*c* and 20*d* and slides up between the sides of each spring clip 20 until the retaining brackets 24 come in contact with the spring clip 20. The frictional engagement between the sides of the spring clip 20 and the intermediate straight portion 22*c* maintain the frame member 10 in the down position. Preferably, the base portion 18 and the eyeshield member 22 are each made from a rigid continuous spring steel wire.

Figure 2:
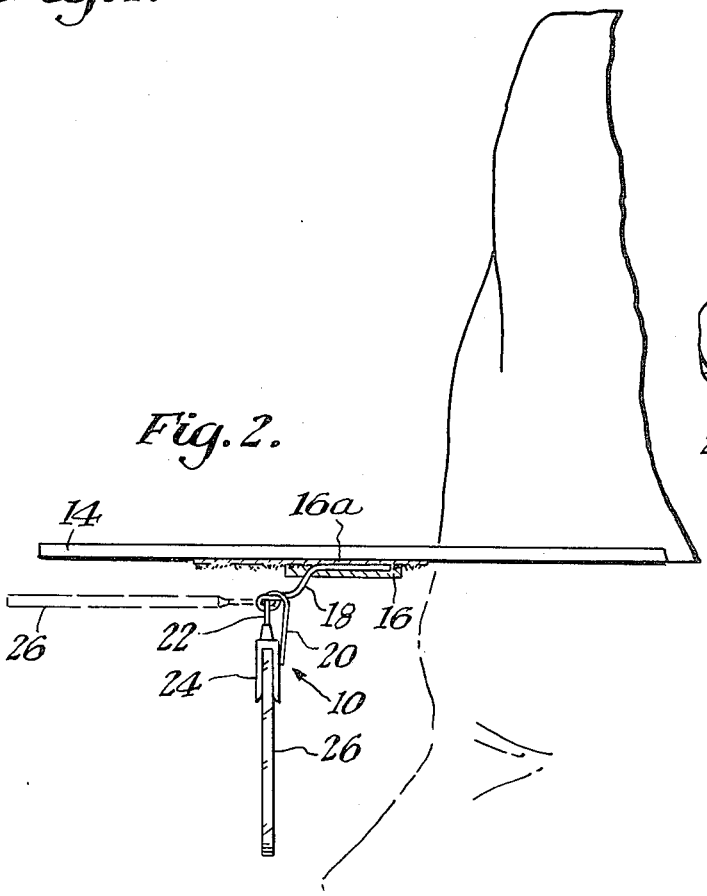
FIG. 2 is a fragmentary side view of the device attached to the visor of a cap worn by the wearer.

As shown in FIG. 2, the device 10 enables the eye shield 26 to be placed in a down position in the line of vision of the user. When in this position the eye shield retaining member 24 locks into position against the spring clip 20 which are sized and shaped to maintain the eye shield member 22 in the down position. Also, when in the up position the eye shield member 22 also locks into that position due to the size and shape of the spring clips 20. The base portion 18 of the device fits between the velcro strips 16 and 16*a*, the velcro strip 16*a* being attached to the cap visor 14. The use of the velcro strips 16 and 16*a* enables the eyeshield to be adjusted relative to the bottom surface of the visor 14 to regulate the distance of the eye shields from the tie of the user.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A removable device for attaching an eye shield, spectacles, safety shield or the like to the lower surface of the visor of a cap, comprising:

at least one frame member, each said frame member having a base portion, an eye shield retaining member portion, and a biasing means for holding said eye shield retaining member portion in an open position or in a closed position, said biasing means operably connected to said frame member;

a first fabric fastening strip mounted on said lower surface; and a second fabric fastening strip for each said frame member, each said second fabric fastening strip attachable to the first strip for retaining said frame base portion therebetween.

2. A device for attaching an eye shield, spectacles, safety shield or the like to the lower surface of the visor of a cap as set forth in claim 1, wherein:

said base portion includes a first rigid continuous spring steel wire;

said biasing means includes a pair of spring clips made from said first rigid continuous spring steel wire contiguous therewith; and said eye shield retaining member portion includes a second rigid steel wire operably engaged with said spring clips whereby said eye shield retaining member portion may pivot within said spring clips.

3. A device as in claim 1, wherein:

said eye shield retaining member portion further includes a pair of U-shaped clamp members, each said clamp member attached to a respective end of said eye shield retainer member portion for slidably engaging the eye shield.

* * * * *